US010320157B1

(12) United States Patent
Maki

(10) Patent No.: US 10,320,157 B1
(45) Date of Patent: Jun. 11, 2019

(54) SPARK PLUG AND METHOD FOR MANUFACTURING THE SAME

(71) Applicant: NGK Spark Plug Co., LTD., Nagoya (JP)

(72) Inventor: Shunsuke Maki, Konan (JP)

(73) Assignee: NGK SPARK PLUG CO., LTD., Nagoya (JP)

( * ) Notice: Subject to any disclaimer, the term of this patent is extended or adjusted under 35 U.S.C. 154(b) by 0 days.

(21) Appl. No.: 16/193,262

(22) Filed: Nov. 16, 2018

(30) Foreign Application Priority Data

Nov. 27, 2017 (JP) ..... 2017-226469

(51) Int. Cl.
*H01T 13/08* (2006.01)
*H01T 21/02* (2006.01)
*H01T 13/32* (2006.01)

(52) U.S. Cl.
CPC ..... *H01T 13/08* (2013.01); *H01T 13/32* (2013.01); *H01T 21/02* (2013.01)

(58) Field of Classification Search
CPC ..... H01T 13/08
See application file for complete search history.

(56) References Cited

U.S. PATENT DOCUMENTS 6,357,274 B1 3/2002 Tanaka et al.
8,970,097 B2 * 3/2015 Yamada ..... H01T 13/08 313/118
2006/0284535 A1 * 12/2006 Ozeki ..... G01L 23/22 313/143

FOREIGN PATENT DOCUMENTS

JP 2001-121240 A 5/2001

* cited by examiner

*Primary Examiner* — Donald L Raleigh
(74) *Attorney, Agent, or Firm* — Leason Ellis LLP

(57) ABSTRACT

A spark plug includes a tubular metal shell having a tapered portion that projects radially outward with respect to an external thread and is provided on a rear end side of the metal shell with respect to the external thread, a center electrode held in an insulated manner at a center of the metal shell on a front end side thereof, and a ground electrode connected to the metal shell to form a spark gap between the ground electrode and the center electrode. The tapered portion has a contact portion that contacts the inner surface of a plug hole formed in an engine when the external thread is tightened into a threaded hole in the plug hole. The Vickers hardness of the contact portion is higher than the Vickers hardness of at least a part of a portion between the contact portion and the external thread.

3 Claims, 3 Drawing Sheets

SPARK PLUG AND METHOD FOR MANUFACTURING THE SAME

This application claims the benefit of Japanese Patent Application No. 2017-226469, filed Nov. 27, 2017, which is incorporated herein by reference in its entirety.

FIELD OF THE INVENTION

The present invention relates to a spark plug and a method for manufacturing the spark plug, and more particularly, to a spark plug having airtightness secured by a tapered portion and a method for manufacturing the spark plug.

BACKGROUND OF THE INVENTION

In a spark plug in which a ground electrode is connected to a metal shell having an external thread and a tapered portion formed on the outer peripheral surface thereof, a spark gap is formed between the ground electrode and a center electrode that is held by the metal shell in an insulated manner. In this type of spark plug, when the external thread of the metal shell is tightened into a threaded hole in a plug hole formed in an engine, a contact portion of the tapered portion is brought into contact with the inner surface of the plug hole. Thus, the ground electrode is positioned about an axis and in an axial direction.

Japanese Unexamined Publication No. 2001-121240 discloses a spark plug processed by cold forging over a range from an external thread of a metal shell to a tapered portion thereof. In the technology disclosed in Japanese Unexamined Publication No. 2001-121240, a contact portion subjected to work hardening by cold forging is difficult to deform. Thus, a ground electrode can easily be positioned by an appropriate tightening torque at a position about an axis where a flow of an air-fuel mixture is not hindered.

In the related art, however, the work hardening is caused by cold forging over the range from the external thread of the metal shell to the tapered portion thereof. Therefore, a portion between the external thread and the contact portion may be cracked and broken by the tightening torque of the external thread.

SUMMARY OF THE INVENTION

The present invention has been made to solve the problem described above and has an object to provide a spark plug and a method for manufacturing the spark plug, in which a portion between an external thread and a contact portion can be made difficult to crack while increasing the hardness of the contact portion.

In order to achieve this object, a spark plug according to a first aspect of the present invention includes a tubular metal shell having an external thread formed on a part of an outer peripheral surface of the metal shell, and a tapered portion that projects radially outward with respect to the external thread and is provided on a rear end side of the metal shell with respect to the external thread, a center electrode held in an insulated manner at a center of the metal shell on a front end side thereof, and a ground electrode connected to the metal shell to form a spark gap between the ground electrode and the center electrode. The tapered portion has a contact portion that contacts an inner surface of a plug hole formed in an engine when the external thread is tightened into a threaded hole in the plug hole. A Vickers hardness of the contact portion is higher than a Vickers hardness of at least a part of a portion between the contact portion and the external thread of the metal shell.

A method for manufacturing the spark plug according to a second aspect of the present invention includes a metal shell manufacturing step. The metal shell manufacturing step includes a softening step of reducing the Vickers hardness of at least the part of the portion between the contact portion and the external thread of the metal shell compared with the Vickers hardness of the contact portion of the metal shell.

A method for manufacturing the spark plug according to a third aspect of the present invention includes a metal shell manufacturing step. The metal shell manufacturing step includes a hardening step of increasing the Vickers hardness of the contact portion of the metal shell compared with the Vickers hardness of at least the part of the portion between the contact portion and the external thread of the metal shell.

According to the spark plug of the first aspect, the Vickers hardness of the contact portion is higher than the Vickers hardness of at least the part of the portion between the contact portion and the external thread of the metal shell. Therefore, at least the part of the portion between the contact portion and the external thread can be deformed easily. As a result, the portion between the external thread and the contact portion can be made difficult to crack while increasing the hardness of the contact portion.

According to the method for manufacturing the spark plug of the second aspect, in the softening step, the Vickers hardness of at least the part of the portion between the contact portion and the external thread of the metal shell is reduced compared with the Vickers hardness of the contact portion of the metal shell. Therefore, at least the part of the portion between the contact portion and the external thread can be deformed easily. As a result, the portion between the external thread and the contact portion can be made difficult to crack while increasing the hardness of the contact portion.

According to the method for manufacturing the spark plug of the third aspect, in the hardening step, the Vickers hardness of the contact portion of the metal shell is increased compared with the Vickers hardness of at least the part of the portion between the contact portion and the external thread of the metal shell. Therefore, at least the part of the portion between the contact portion and the external thread can be deformed easily. As a result, the portion between the external thread and the contact portion can be made difficult to crack while increasing the hardness of the contact portion.

BRIEF DESCRIPTION OF THE DRAWINGS

These and other features and advantages of the present invention will become more readily appreciated when considered in connection with the following detailed description and appended drawings, wherein like designations denote like elements in the various views, and wherein.

DETAILED DESCRIPTION OF THE INVENTION

Figure 1:
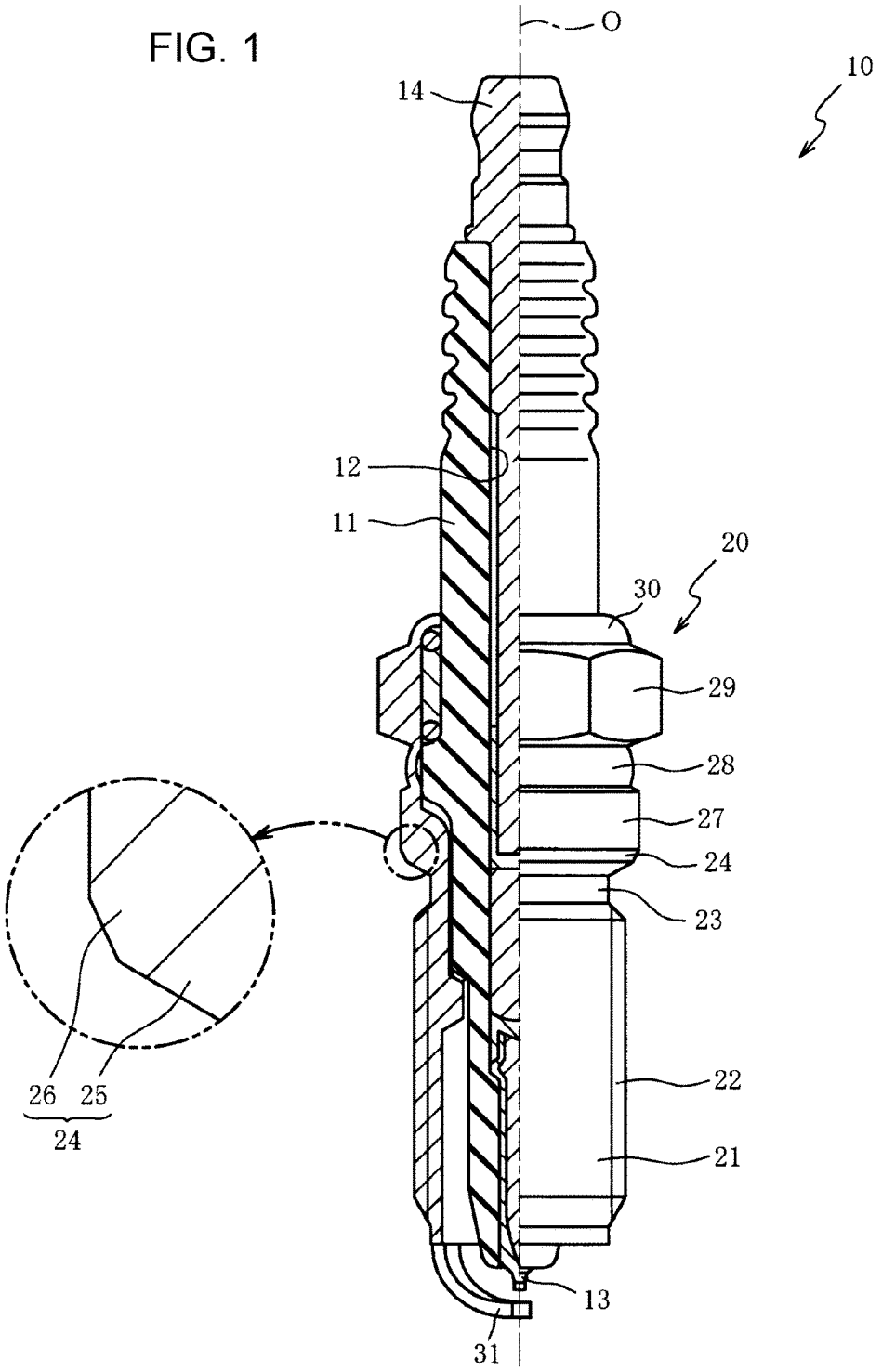
FIG. 1 is a half sectional view of a spark plug according to one embodiment of the present invention.

A preferred embodiment of the present invention is described below with reference to the accompanying drawings. FIG. 1 is a half sectional view of a spark plug 10 according to one embodiment of the present invention. In FIG. 1, the lower side of the drawing sheet is referred to as a front end side of the spark plug 10 and the upper side of the drawing sheet is referred to as a rear end side of the spark plug 10 (the same applies to FIG. 2 and FIG. 3). The spark plug 10 includes an insulator 11 and a metal shell 20.

The insulator 11 is a member formed of, for example, alumina that is excellent in mechanical properties and insulation properties under high temperature. An axial hole 12 is formed through the insulator 11 along an axial line O. A center electrode 13 is arranged on the front end side of the axial hole 12.

The center electrode 13 is a rod-shaped member extending along the axial line O. A core material that is copper or contains copper as a main component is covered with a base material that is nickel or a nickel-based alloy. The center electrode 13 is held by the insulator 11 and the front end is exposed from the axial hole 12.

A metal terminal 14 is a rod-shaped member to which a high-voltage cable (not illustrated) is connected. The metal terminal 14 is formed of a conductive metal material (for example, low-carbon steel). The metal terminal 14 is fixed to the rear end of the insulator 11 in a state in which the front end side of the metal terminal 14 is inserted into the axial hole 12. The metal terminal 14 is electrically connected to the center electrode 13 inside the axial hole 12.

The metal shell 20 is fixed to the front end side of the outer periphery of the insulator 11 that is spaced away from the rear end of the insulator 11 in a direction of the axial line O by a predetermined distance while securing an insulation distance from the metal terminal 14. The metal shell 20 is a substantially cylindrical member formed of a conductive metal material (for example, low-carbon steel).

The metal shell 20 has a front end portion 21, a cylindrical portion 23, a tapered portion 24, and a seating portion 27 that are continuously connected to each other in this order from the front end side to the rear end side along the axial line O. An external thread 22 is formed on the outer peripheral surface of the front end portion 21. The outside diameter of the cylindrical portion 23 is smaller than the minor diameter of the external thread 22. The outside diameter of the seating portion 27 is larger than the major diameter of the external thread 22. The tapered portion 24 is a conical portion that connects the seating portion 27 and the cylindrical portion 23 to each other. The outside diameter of the tapered portion 24 increases toward the rear end side.

In this embodiment, the tapered portion 24 has a first portion 25 continuously connected to the cylindrical portion 23, and a second portion 26 continuously connected to the rear end side of the first portion 25 and adjacent to the seating portion 27. The taper angle of the outer peripheral surface of the first portion 25 with respect to the axial line O is larger than the taper angle of the outer peripheral surface of the second portion 26 with respect to the axial line O.

The metal shell 20 has a bent portion 28, a tool engagement portion 29, and a rear end portion 30 that are continuously connected to the rear end side of the seating portion 27 in this order from the front end side along the axial line O. The rear end portion 30 is a portion that is bent inward at the time of assembling to restrict movement of the insulator 11 attached to the metal shell 20 toward the rear end side. The tool engagement portion 29 is a portion where a tool such as a wrench is engaged when the spark plug 10 is installed in a plug hole 41 of an engine 40 (described later). The bent portion 28 is a portion for fixing the metal shell 20 by crimping by being plastically deformed (bent) when the metal shell 20 is attached to the insulator 11.

A ground electrode 31 is a member formed of a metal (for example, a nickel-based alloy) and joined to the metal shell 20. In this embodiment, the ground electrode 31 is formed into a rod shape. The front end side of the ground electrode 31 is bent to face the center electrode 13. The ground electrode 31 forms a spark gap between the ground electrode 31 and the center electrode 13.

For example, the spark plug 10 is manufactured by the following method. First, the center electrode 13 is inserted into the axial hole 12 of the insulator 11 and is arranged so that the front end of the center electrode 13 is exposed to the outside from the axial hole 12. The metal terminal 14 and the center electrode 13 are electrically connected to each other while inserting the metal terminal 14 into the axial hole 12. Then, the insulator 11 is inserted into the metal shell 20 to which the ground electrode 31 is joined in advance. The bent portion 28 and the rear end portion 30 are plastically deformed while pressing the tapered portion 24 of the metal shell 20 against a tool (not illustrated), thereby attaching the metal shell 20 to the outer periphery of the insulator 11. Subsequently, the ground electrode 31 is bent so as to face the center electrode 13. Thus, the spark plug 10 is attained.

Figure 2:
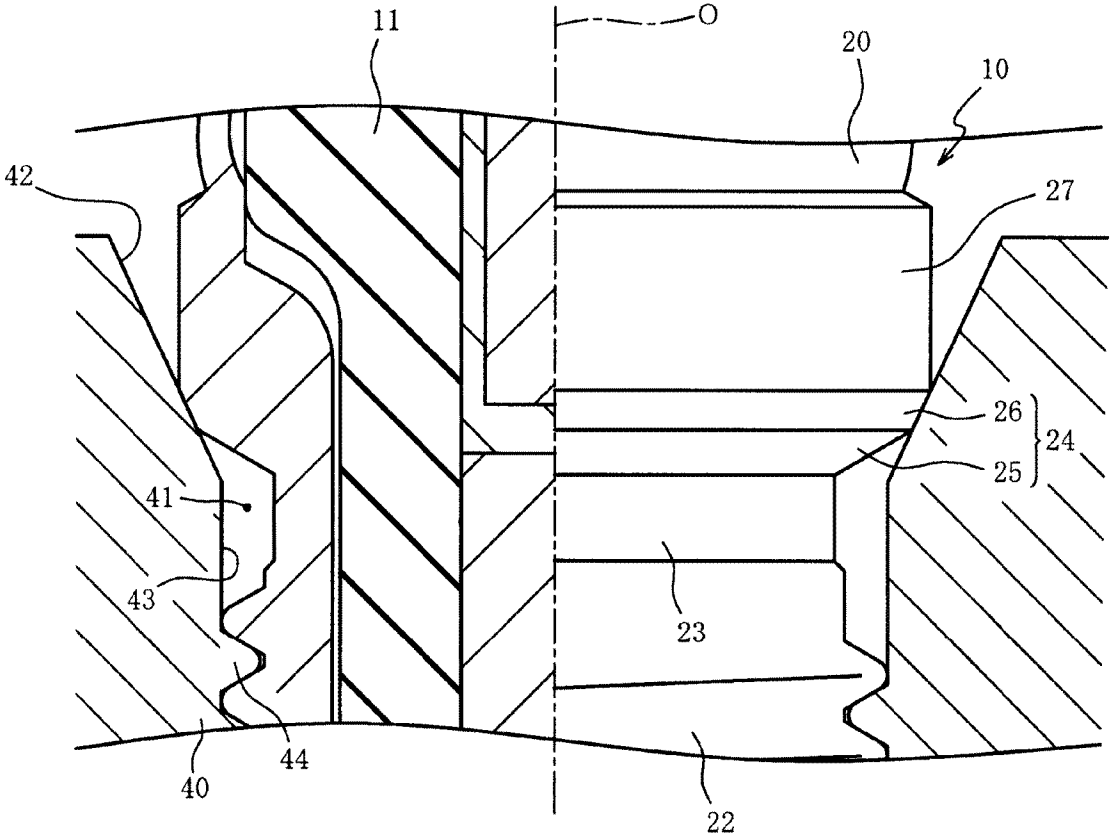
FIG. 2 is a half sectional view of a part of the spark plug installed in an engine.

FIG. 2 is a half sectional view of a part of the spark plug 10 (near the tapered portion 24) installed in the engine 40. As illustrated in FIG. 2, the plug hole 41 that communicates with a combustion chamber (not illustrated) is formed in the engine 40. An inner surface 42 of the plug hole 41 is a conical surface having a diameter decreasing toward the combustion chamber of the engine 40. A threaded hole 43 having an internal thread 44 is continuously connected to a part of the inner surface 42 of the plug hole 41 where the bore is smallest.

In this embodiment, when the external thread 22 formed on the metal shell 20 of the spark plug 10 is tightened into the threaded hole 43, the second portion 26 (contact portion) of the tapered portion 24 is brought into contact with the inner surface 42 of the plug hole 41 and a space is formed between the inner surface 42 and the first portion 25 and between the threaded hole 43 and the first portion 25. Through the contact of the second portion 26 with the inner surface 42 of the plug hole 41, the ground electrode 31 is positioned in the direction of the axial line O and about the axial line O.

The metal shell 20 is manufactured so that the Vickers hardness of the second portion 26 becomes higher than the Vickers hardnesses of the first portion 25 and the cylindrical portion 23. Therefore, the second portion 26 can be made more difficult to deform than the first portion 25 and the cylindrical portion 23. Thus, the deformation amount of the second portion 26 in contact with the inner surface 42 of the plug hole 41 can be made difficult to vary by an appropriate tightening torque. Accordingly, the ground electrode 31 can easily be positioned at a position about the axial line O where a flow of an air-fuel mixture in the engine 40 is not hindered.

The first portion 25 and the cylindrical portion 23 can be deformed more easily than the second portion 26. Therefore, the first portion 25 and the cylindrical portion 23 can be made difficult to crack by the tightening torque of the external thread 22. As a result, the first portion 25 and the cylindrical portion 23 (in particular, the thin cylindrical portion 23) can be prevented from being broken. The Vickers hardness is a value measured based on JIS Z 2244: 2009.

The second portion 26 of the tapered portion 24 of the spark plug 10 is brought into contact with the inner surface 42 of the plug hole 41. As a result, when the same axial force is applied to the external thread 22, the load applied to the inner surface 42 of the plug hole 41 by the second portion 26 can be increased compared with a case in which the entire tapered portion 24 is brought into contact with the inner surface 42 of the plug hole 41. As a result, the airtightness attained by the tapered portion 24 can be improved.

The entire second portion 26 need not essentially be brought into contact with the inner surface 42 of the plug hole 41. The contour of the second portion 26 may be set so that a part of the second portion 26 near the boundary between the seating portion 27 and the second portion 26 or a part of the second portion 26 near the boundary between the first portion 25 and the second portion 26 (both are parts of the second portion 26) is brought into contact with the inner surface 42 of the plug hole 41. Also when the part of the second portion 26 (contact portion) is brought into contact with the inner surface 42 of the plug hole 41, the airtightness can be secured as long as the entire periphery of the second portion 26 is continuously brought into contact with the inner surface 42 of the plug hole 41. The first portion 25 and the cylindrical portion 23 each having a Vickers hardness lower than that of the second portion 26 are present between the second portion 26 and the external thread 22. Therefore, the first portion 25 and the cylindrical portion 23 can be made difficult to crack by the tightening torque of the external thread 22.

In the manufacturing process of the spark plug 10, when the metal shell 20 is attached to the outer periphery of the insulator 11, the metal shell 20 is fixed by crimping by plastically deforming the bent portion 28 and the rear end portion 30 while pressing the second portion 26 against the tool (not illustrated). Since the hardness of the second portion 26 is high, sinking subsidence (deformation) of the second portion 26 can be prevented when the metal shell 20 is attached to the outer periphery of the insulator 11.

Figure 3:
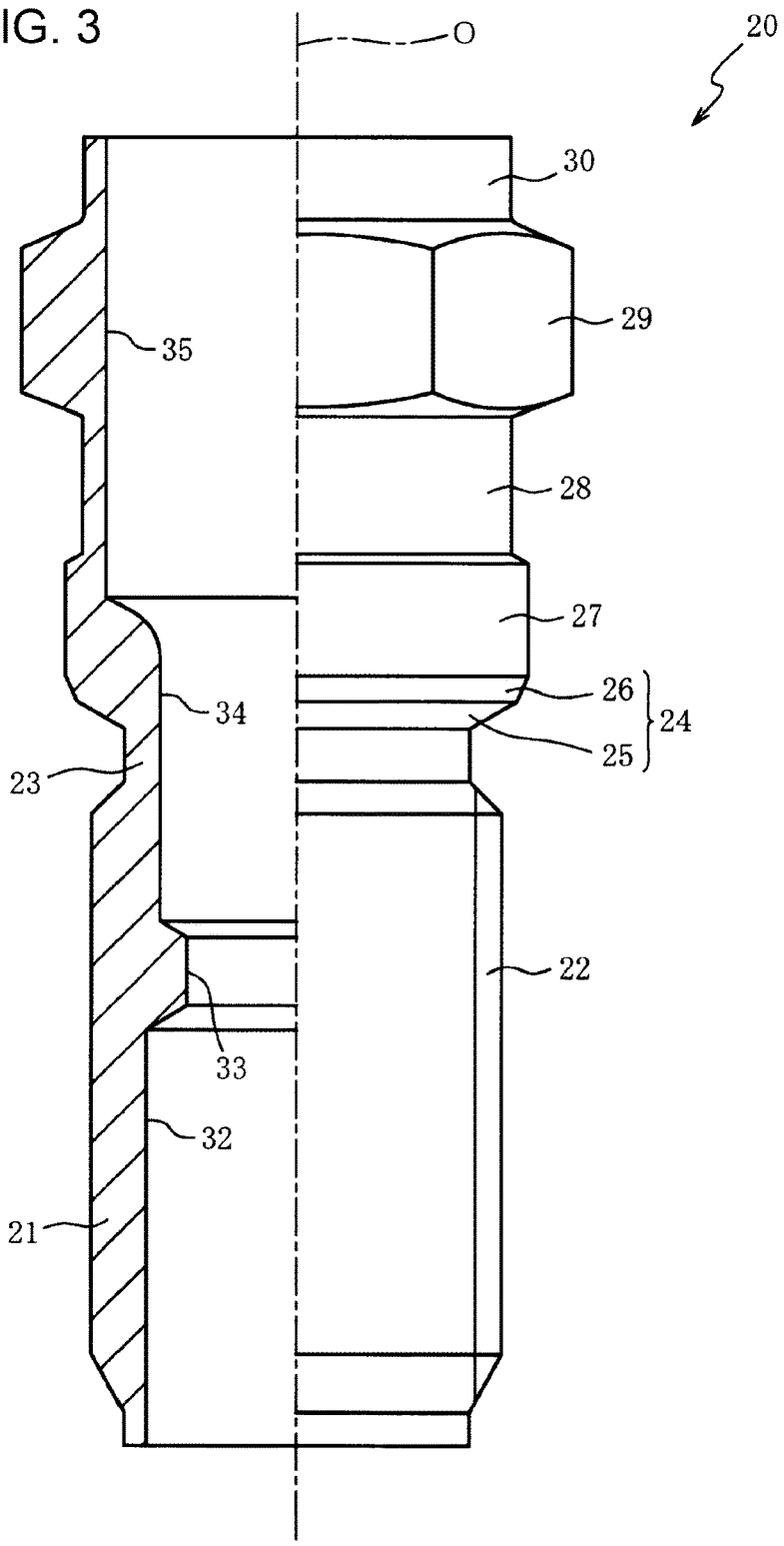
FIG. 3 is a half sectional view of a metal shell.

Next, a method for manufacturing the metal shell 20 is described with reference to FIG. 3. FIG. 3 is a half sectional view of the metal shell 20 before the metal shell 20 is attached to the insulator 11 and before the ground electrode 31 is joined to the metal shell 20. In FIG. 3, illustration of ridges of the external thread 22 is omitted.

As illustrated in FIG. 3, the metal shell 20 has a first hole 32, a second hole 33, a third hole 34, and a fourth hole 35 that are continuously connected to each other in this order from the front end side to the rear end side along the axial line O. The first hole 32 and the second hole 33 are located on the inner side of the front end portion 21. The bore of the second hole 33 is smaller than the bore of the first hole 32. The third hole 34 and the fourth hole 35 are located on the inner side of the metal shell 20 in a range from the rear end side of the front end portion 21 to the rear end portion 30. The bore of the fourth hole 35 is larger than the bore of the third hole 34.

The metal shell 20 is manufactured by processing an intermediate product (not illustrated). The intermediate product is a substantially columnar member formed by, for example, cold forging of a metal material such as low-carbon steel or stainless steel. In a metal shell manufacturing step of manufacturing the metal shell 20, the tool engagement portion 29 is first formed on the outer periphery of the intermediate product (not illustrated) by cold forging. Subsequently, the front end portion 21, the cylindrical portion 23, the tapered portion 24, the seating portion 27, and the bent portion 28 are formed on the outer periphery of the intermediate product (not illustrated) by cutting work that uses a lathe or the like. Subsequently, the first hole 32, the second hole 33, the third hole 34, and the fourth hole 35 are formed by using drills having different diameters (not illustrated). By forming those portions by cutting work, the accuracies of the contour, hole shapes, dimensions, and the like can be increased.

Next, in a hardening step, the surface layer of the second portion 26 of the intermediate product that rotates about the axial line O is plastically deformed by roller burnishing in which a hard roller (not illustrated) is pressed against the second portion 26. Thus, the surface roughness of the second portion 26 is reduced and the surface of the second portion 26 is subjected to work hardening so that the Vickers hardness of the second portion 26 becomes higher than the Vickers hardnesses of the cylindrical portion 23 and the first portion 25.

Subsequently, a thread is formed on the front end portion 21 by rolling and the external thread 22 is subjected to work hardening.

According to this method, the second portion 26 is hardened by roller burnishing. Therefore, the surface roughness of the second portion 26 can be reduced and the dimensional accuracy of the second portion 26 can be increased. By reducing the surface roughness of the second portion 26, the airtightness can be improved. By the roller burnishing, the second portion 26 alone can be hardened within a short period of time.

The means for hardening the second portion 26 in the hardening step is not limited to the roller burnishing. Examples of other means for hardening the second portion 26 include quenching such as laser quenching, spark hardening, and shot peening.

The embodiment described above is directed to the case in which the second portion 26 of the metal shell 20 is hardened compared with the cylindrical portion 23. The present invention is not limited to this case. Another method for manufacturing the metal shell 20 in which the second portion 26 is hardened compared with the cylindrical portion 23 (the cylindrical portion 23 is softened compared with the second portion 26) is described below with reference to FIG. 3.

In the metal shell manufacturing step of manufacturing the metal shell 20, the contour of the metal shell 20 and the holes thereof are formed by cold forging such as extrusion or punching that uses a press. The second portion 26 of the metal shell 20 is subjected to work hardening by cold forging.

Next, in a softening step, the surface layers of the first portion 25 and the cylindrical portion 23 are removed by cutting. Thus, the Vickers hardness of the second portion 26 becomes higher than the Vickers hardnesses of the first portion 25 and the cylindrical portion 23. By the cutting, the boundary between the first portion 25 and the second portion 26 is formed. Therefore, the dimensional accuracy of the boundary between the first portion 25 and the second portion 26 can be improved compared with the case in which the whole of the first portion 25 and the second portion 26 is formed by forging.

By increasing the Vickers hardness of the second portion 26 compared with the Vickers hardnesses of the first portion 25 and the cylindrical portion 23, the second portion 26 can be made more difficult to deform than the first portion 25 and the cylindrical portion 23. As a result, the deformation amount of the second portion 26 in contact with the inner surface 42 of the plug hole 41 can be made difficult to vary by an appropriate tightening torque. Further, the first portion 25 and the cylindrical portion 23 can be deformed more easily than the second portion 26. Therefore, the first portion 25 and the cylindrical portion 23 can be made difficult to crack by the tightening torque of the external thread 22.

The means for softening the first portion 25 and the cylindrical portion 23 in the softening step is not limited to the cutting work. Examples of other means for softening the first portion 25 and the cylindrical portion 23 include annealing.

The present invention has been described above based on the embodiment but is not limited to the embodiment described above. It can easily be understood that various modifications may be made without departing from the spirit of the present invention.

The embodiment is directed to the case in which the Vickers hardness of the second portion 26 is higher than the Vickers hardnesses of the cylindrical portion 23 and the first portion 25. The present invention is not necessarily limited to this case. For example, as long as the Vickers hardness of the second portion 26 is higher than the Vickers hardness of the cylindrical portion 23 or the first portion 25, the deformation amount of the second portion 26 in contact with the inner surface 42 of the plug hole 41 can be made difficult to vary by an appropriate tightening torque. Further, the first portion 25 or the cylindrical portion 23 can be deformed more easily than the second portion 26. Therefore, a crack can be made difficult to occur between the external thread 22 and the second portion 26 (contact portion) by the tightening torque of the external thread 22.

The embodiment is directed to the case in which the tapered portion 24 of the metal shell 20 has the first portion 25 and the second portion 26 having different taper angles. The present invention is not necessarily limited to this case. The cylindrical portion 23 and the seating portion 27 may be connected to each other by a conical surface as the tapered portion 24 without providing the first portion 25 and the second portion 26 having different taper angles. In this case, the contact portion is a part of the tapered portion 24 that is brought into contact with the inner surface 42 of the plug hole 41 (at least a part of the tapered portion 24).

The embodiment is directed to the case in which the outer peripheral surface of the tapered portion 24 is a conical surface. The present invention is not necessarily limited to this case. A tapered portion 24 whose outer peripheral surface has a spherical band shape may be provided. Also in this case, the contact portion is a part of the tapered portion 24 that is brought into contact with the inner surface 42 of the plug hole 41 (at least a part of the tapered portion 24).

The embodiment is directed to the case in which the outside diameter of the cylindrical portion 23 of the metal shell 20 is smaller than the minor diameter of the external thread 22 of the metal shell 20. The present invention is not necessarily limited to this case. The outside diameter of the cylindrical portion 23 of the metal shell 20 and the minor diameter of the external thread 22 of the metal shell 20 may be set to equal dimensions. The embodiment is directed to the case in which the outside diameter of the bent portion 28 of the metal shell 20 is smaller than the outside diameter of the seating portion 27 of the metal shell 20. The present invention is not necessarily limited to this case. The outside diameter of the bent portion 28 of the metal shell 20 and the outside diameter of the seating portion 27 of the metal shell 20 may be set to equal dimensions. Those cases are advantageous when the metal shell 20 is formed by cold forging.

Although description is omitted in the embodiment, a plating layer of zinc plating, nickel plating, or the like may be formed on the metal shell 20. Further, the surface of the plating layer may be subjected to chromate treatment.

The embodiment is directed to the case in which the ground electrode 31 joined to the metal shell 20 is bent. The present invention is not necessarily limited to this case. A linear ground electrode may be used instead of using the bent ground electrode 31. In this case, the linear ground electrode is caused to face the center electrode 13 by extending the front end side of the metal shell 20 in the direction of the axial line O and joining the ground electrode to the metal shell 20.

What is claimed is:

1. A spark plug, comprising:

a tubular metal shell having an external thread formed on a part of an outer peripheral surface of the metal shell, and a tapered portion that projects radially outward with respect to the external thread and is provided on a rear end side of the metal shell with respect to the external thread;

a center electrode held in an insulated manner at a center of the metal shell on a front end side thereof; and a ground electrode connected to the metal shell to form a spark gap between the ground electrode and the center electrode, wherein the tapered portion has a contact portion that contacts an inner surface of a plug hole formed in an engine when the external thread is tightened into a threaded hole in the plug hole, and wherein a Vickers hardness of the contact portion is higher than a Vickers hardness of at least a part of a portion between the contact portion and the external thread of the metal shell.

2. A method for manufacturing the spark plug according to claim 1, the method comprising a metal shell manufacturing step, wherein the metal shell manufacturing step comprises a softening step of reducing the Vickers hardness of at least the part of the portion between the contact portion and the external thread of the metal shell compared with the Vickers hardness of the contact portion of the metal shell.

3. A method for manufacturing the spark plug according to claim 1, the method comprising a metal shell manufacturing step, wherein the metal shell manufacturing step comprises a hardening step of increasing the Vickers hardness of the contact portion of the metal shell compared with the Vickers hardness of at least the part of the portion between the contact portion and the external thread of the metal shell.

* * * * *